United States Patent [19]

Herbst

[11] 3,978,674

[45] Sept. 7, 1976

[54] DEVICE FOR THE DISCHARGE OF COMPRESSION MATERIAL IN THE PRODUCTION OF THE COMPRESSION MEMBER OF A PULL AND PRESSURE ANCHOR

[75] Inventor: Thomas Herbst, Munich, Germany

[73] Assignee: Dyckerhoff & Widmann Aktiengesellschaft, Munich, Germany

[22] Filed: Nov. 28, 1973

[21] Appl. No.: 419,617

[30] Foreign Application Priority Data

Dec. 6, 1972 Germany ..... 2259648
Aug. 16, 1973 Germany ..... 2341279

[52] U.S. Cl. ..... 61/39; 61/45 B
[51] Int. Cl.[2] ..... E02D 5/00
[58] Field of Search ..... 61/39, 35, 36, 45 B; 52/698, 704, 155, 156, 158

[56] References Cited

UNITED STATES PATENTS 3,250,075 5/1966 Webb et al. ..... 61/39
3,270,469 9/1966 Debiton ..... 52/155 X
3,665,717 5/1972 Sweeney et al. ..... 61/39

FOREIGN PATENTS OR APPLICATIONS 259,462 1/1968 Austria ..... 61/39

*Primary Examiner*—Dennis L. Taylor
*Attorney, Agent, or Firm*—Frank L. Durr; Orville N. Greene

[57] ABSTRACT

The disclosure relates to an anchoring device adapted to hold one end of a to-be-stressed linear member within the bore hole of an earth formation. The anchor device has a tubular body surrounding and retaining a section of the linear member and has a compression channel extending along the circumferential portion of the body. The compression channel being open to the outside of the tubular body through a substantial part of its intermediate length to form a distribution channel. Means are provided for feeding hardenable material under pressure to the regions outside the device to compress the earth surrounding the bore hole. The body is covered with a sleeve of elastic material encompassing the body to normally cover the open part of the distribution channel.

8 Claims, 8 Drawing Figures

Figure 1:
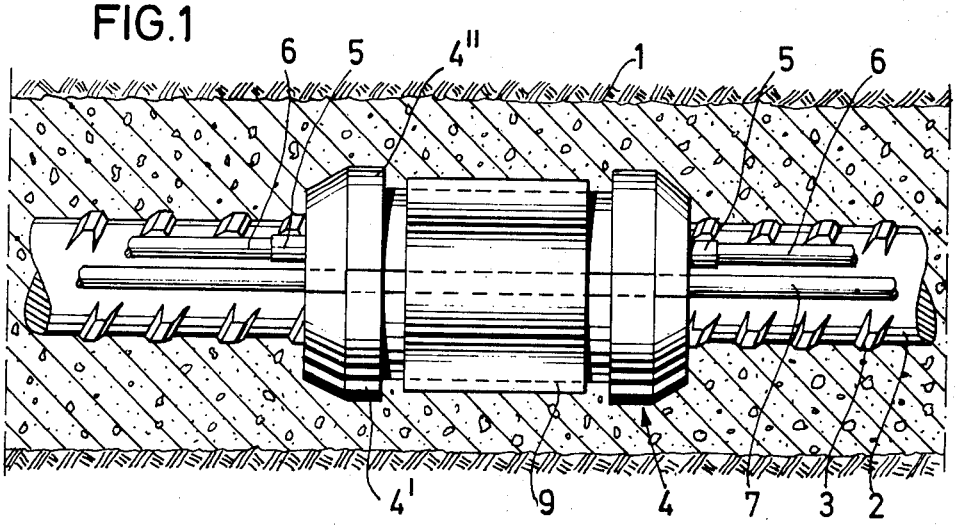

DEVICE FOR THE DISCHARGE OF COMPRESSION MATERIAL IN THE PRODUCTION OF THE COMPRESSION MEMBER OF A PULL AND PRESSURE ANCHOR

The invention relates to a device for the discharge of compression material supplied by way of a compression conduit or duct in the manufacture of the compression body of a pull or pressure anchor having preferably rod-like steel inserts.

In the production of ground anchors, particularly in loamy soil, it is known to blow open the ground in sections repeatedly by using high compression pressure, and in this manner to intermingle it with compression material or to compress it and to obtain a larger diameter of the compression body. In this manner it is possible to obtain a more and more intensive penetration of the ground and improved local demarcation.

For carrying out this compressing it is known to introduce a tube into the bore after the completion of the bore hole and insertion of the tension member, the wall of which is provided with apertures distributed at axial distances along the circumference. These apertures are covered on the outside with sleeves which constitute relief or non-return valves for the compression material that is forced through the apertures. If the compression material is introduced into the tube under pressure, it departs at the apertures and thereby expands the sleeves. The cement stone that surrounds the sleeves of the preceding already hardened compression material is thereby broken open and the compression material penetrates into the ground.

If these tubes are used in combination with the steel tension or pressure members in the ground, then there results with this arrangement a relatively large bore hole diameter alongside one another. In order to make the breaking open of the ground as effective as possible, the surface area through which the pressure of the compression material can act must be as large as possible. Thus, the larger the diameter of the sleeve tube becomes, the larger will be the expansion surface and the more effective will be the compression system, but also the space requirement for the compression system in the bore hole during the construction condition will become that much larger.

In order to effect a repeated directed compressing of compression anchors more safely and quickly, especially in binding soils, it has already been proposed to provide two tubular compression conduits that are connected with one another on the ground side instead of a sleeve tube for each compression section, which together have at least one compression opening in the particular compression section.

It is an object of the invention to find within the scope of this closed compression conduit a configuration for the compression apertures which has an expansion surface that is as large as possible and therefore works simply and safe from obstruction, and which furthermore avoids the shortcomings of the known sleeve tubes.

The invention proposes two solutions for this problem which are essentially equal. The one solution consists in a substantially hollow cylindrical body in the form of a sleeve encompassing one or more steel inserts with at least one through-going compression channel, which preferably is opened along the largest portion of its length (the open section being referred to below as the distribution channel) and is sealed in a known manner by a sleeve of elastic material which encompasses the body.

The advantage of this body consists in that its annular arrangement around the steel inserts during subsequent pressing of the originally introduced and already hardened cement mortar that is directly in adhering connection with the rod is no longer destroyed. The compression material that is subsequently pressed in instead penetrates directly into the gap between the compression body and ground where the adhesion improvement takes place. The annular disposition of the arrangement about the steel also makes it independent of any special installation position, because the discharge openings are present about the entire circumference. Finally, the body acts simultaneously as a spacer, so that the anchor tension or pressure member is always surrounded by the necessary covering of compression material for corrosion protection and adhesion connection. Finally the arrangement in accordance with the invention is suitable in the same manner for the compressing of ground anchors such as pressure posts that are subjected to pull.

The connecting openings of the open or distribution channel with the compression ducts are suitably disposed at the ends. The distribution channel proper suitably extends in its opened area in flatly spread fashion, for example in a meandering manner, over the surface of the hollow, cylindrical body.

At the ends, the hollow, cylindrical body can have a larger diameter than in the central area. The ends may also be flattened out.

The body is suitably so formed that the inside thereof encompasses the steel inserts passed through it in a positive manner. Said body may have an inner thread which can be threadedly received or placed on the steel bar that has a corresponding thread.

The body may also be made of two half shells, each of which is provided with a distribution channel.

The body may furthermore be provided with recesses for passing through the through-going compression ducts that extend in longitudinal direction. These recesses may be arranged as grooves, one half each on the inner surface of the half shells.

The other solution of the problem consists in accordance with the invention of a body of elastic material that varies its volume under pressure in which the pressure conduit is introduced with at least one aperture, where the aperture is covered by the body in the manner of a valve.

The use of a solid body of material that can be elastically compressed provides the advantage that the two main requirements for the effectiveness of a compression valve are met, namely it acts as a one-way valve and has a large pressure surface but is more readily adaptable with its geometric dimensions to the pull or pressure element and to the diameter of the bore hole. The body is also economical and can be produced in any desired shape.

Suitably this body has a longitudinally extending bore for passing through the compression conduit. Suitably it is prismatic, preferably cylindrical, it may have a longitudinally extending recess by means of which it encompasses one or more steel inserts. This recess is suitably in the form of an undercut groove starting from the outer surface.

Suitably the body consists of elastic plastic foam, preferably of polyurethane foam, foam rubber or the like.

Figure 2:
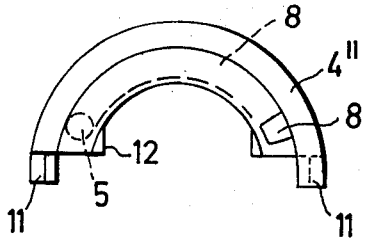
Figure 3:
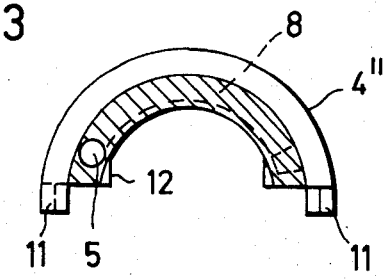
Figure 4:
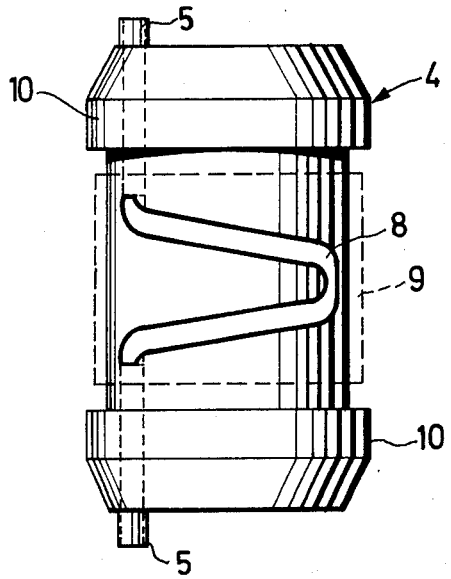
Figure 5:
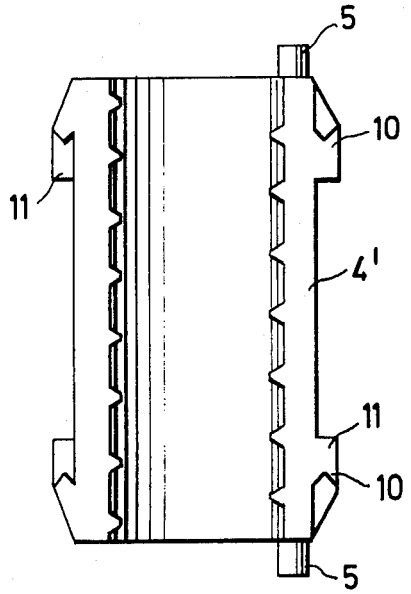
Figure 6:
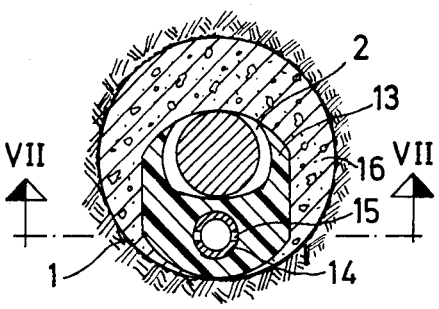
Figure 7:
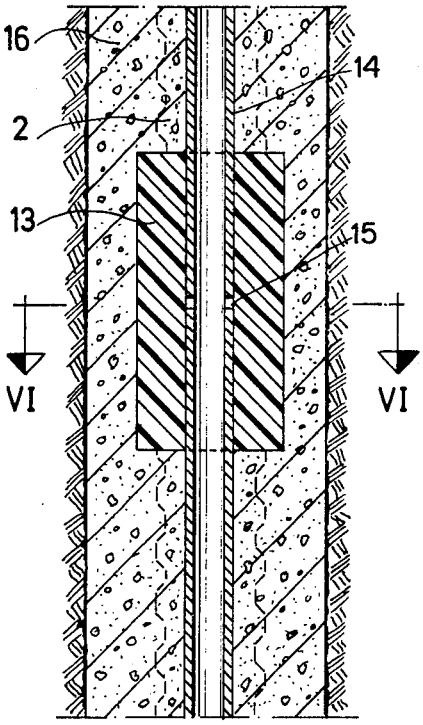
Figure 8:
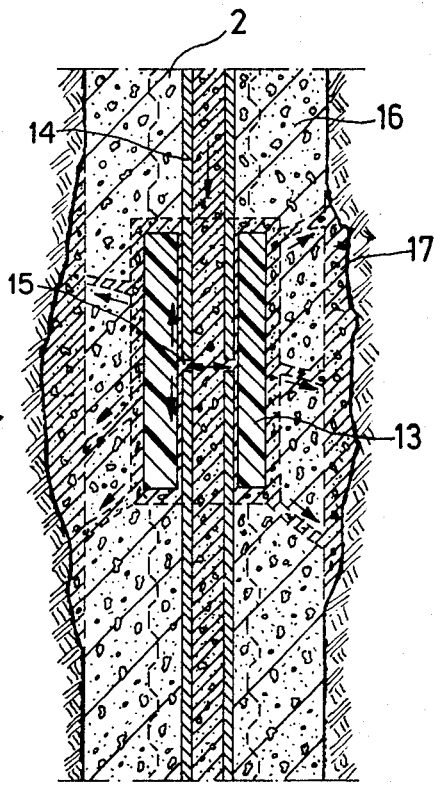

Further features and advantages of the invention will become apparent from the following description with reference to the embodiments illustrated in the drawings, in which FIG. 1 shows a sectional view of a tension member of a ground anchor with a first device in accordance with the invention and the associated compression ducts in installed condition, FIG. 2 is a part in section of a device similar to FIG. 1 consisting of two half shells, FIG. 3 is a corresponding sectional view of the device in accordance with FIG. 2, FIG. 4 is a view of a device with the sleeve of FIG. 1 shown in dotted lines, FIG. 5 is an internal view of the half shell of FIG. 2 or 3, FIG. 6 is a cross-section through a compression member with the other embodiment of the device in accordance with the invention, FIG. 7 is a longitudinal section through this device, and FIG. 8 is a longitudinal section of the device after one compression operation.

A first embodiment of the structural body in accordance with the invention is shown in FIG. 1 in installed and concreted condition. In a bore 1, which for the sake of simplification is illustrated on a horizontal axis, a tension member 2 is located which consists of a single armoring rod that has hot rolled ribs 3 on its surface which are disposed along a hexagonal line. Upon installing the pull member 2 in the bore the remaining hollow space is filled with cement mortar.

The means for the exit of the compression material consists of a cylindrical sleeve member 4 which, for example, may be composed of two half shells 4′ and 4″. Along the ends of the body 4 two extensions 5 are located for connecting a compression conduit 6. The body 4 has a further throughgoing opening through which extends a further compression duct 7 and, as the case may be, also a return conduit for the compression material.

As shown in particular in FIG. 4, the two extensions 5 for the entrance of the compression ducts 6 lead into an open channel 8. This compression and distributing channel 8 extends in as flat a fashion as possible over the surface of the structural body 4 in order to effect a pressure that is distributed as well as possible against the sleeve 9 of elastic that covers the compression channel 8. The compression channel 8 is of meandering configuration.

The body 4 has a larger diameter at the ends than at its central area. In this manner the required distance relative to the wall of the bore can be maintained especially well, which is important for protection against corrosion. Besides, sliding off of the sleeve 9 which is slid on over the raised areas 10 is avoided. If the body is made of two half shells, then they may be maintained under pressure in the final position by means of the sleeve 9.

If the body 4 is made in one piece and as illustrated in the embodiment of FIG. 1, a threaded rod is used as a tension element, then the inside of the body 4 can be equipped with a suitable internal thread and the body may be threadedly received on the rod. In that event, however, care must be taken that the body is fixed in its proper position.

Suitably, however, the body 4 is made of two half shells 4′ and 4″. They have extensions 11 at the outer sides by means of which they can be held together and secured against displacement. In FIGS. 2 and 3 such a half shell is illustrated in an end view (FIG. 2) and in section (FIG. 3). Here the entrance openings for the distribution channel can be seen as well as also the course of the compression channel 8. On the inside knobs 12 are provided which, after the mounting of the half shells on the pull member, are intended to prevent unintentional turning or displacement. The arrangement in accordance with the invention permits in a particularly simple manner the exit of compression material, such as cement slurry, in connection with a throughgoing compression duct which can be repeatedly injected, and the duct can again be cleaned, for example by forcing through water.

The body 4 is also suitable for single or multiple tension members as well as also for compression members. It may also encompass several individual elements, in which case it serves simultaneously as a spacing member for the individual elements and as a spacer with respect to the wall of the bore hole.

FIGS. 6–8 illustrate an embodiment of the other manner of solving the problem in accordance with the invention:

A steel pull member 2 which again is in the form of a single ribbed steel bar is disposed in a bore hole 1. Bodies of plastic foam, for example polyurethane foam, are provided on the steel pull member 2 at predetermined axial distances from one another, which encompass the steel tension member 2 in clamping fashion with a longitudinally extending recess. In the illustrated case of a horizontal or slightly inclined anchor, the bodies 13 serve simultaneously as spacers in the centering of the tension element 2 in the bore hole 1.

The bodies 13 are connected by means of a compression conduit 14 that is provided with apertures 15 which are covered in valve-like manner by the body 13. For this purpose the compression conduit 14, for example in the form of a hose, is provided with apertures 15 and is inserted in a bore of the body 13 having the same or a slightly smaller diameter than that of the compression conduit 14. In this manner the effect of a one-way valve is obtained where the compression material can discharge from the conduit 14 but cannot return. The entire combination is embedded in the compression body 16 which has already hardened.

If the compression conduit 14 is supplied with compression material 17 under high pressure, then this material first moves out through the opening 15 in the compression conduit, and in this connection expands the elastic wall of the bore in the body 13 in a manner that it can arrive along the bore at the outer surface of the body (arrows in FIG. 8). From there the surface of the body is pressed in; a hollow space is formed inside of the compression body 16 that is filled with liquid compression material. If the limit of the compressibility of body 13 is reached, it is blown open under the existing compression pressure of the compression bodies 16 and the compression material 17 can penetrate into the ground.

In this connection the shape of the body 13 may be optional as long as it is ascertained that the direction of the compression surface leads to bursting open of the primary compression body 16. Moreover, the shape of the body 13 may be chosen in a manner that it can be optimally adapted for other requirements, for example, with respect to installation.

Having now described my invention with reference to the embodiments illustrated in the drawings, what I desire to protect by letters patent of the United States is set forth in the appended claims:

1. An anchoring device adapted to hold one end of a to-be-stressed linear member within the bore hole of an earth formation of the type which surrounds the buried end portion of the stressed linear member and comprises distribution means for feeding hardenable material under pressure to the regions outside the device to compress the earth surrounding the bore hole, comprising a tubular body constructed to surround and retain a section of the linear member, at least one compression channel extending along the circumferential portion of said body, means for feeding hardenable material to the compression channel, said compression channel being open to the outside of the tubular body through a substantial part of its intermediate length to form a distribution channel, and a sleeve of elastic material encompassing said body to normally cover the open part of said distribution channel.

2. The device as claimed in claim 1 wherein said body includes tubular extensions at the end of each of said compression channel, said means for feeding hardenable material to the compressor channels comprising distributory conduits connected to said extensions of the compression channels.

3. The device as claimed in claim 1 wherein said distribution channel extends in a meandering manner in relatively flat fashion over the surface of the tubular body.

4. The device as claimed in claim 1 wherein the tubular body has end portions of larger diameter than the intermediate position.

5. The device as claimed in claim 4 wherein said end portions of said tubular body are flat.

6. The device as claimed in claim 1 wherein said linear member presents an exterior threaded structure, and the tubular body has an interior threaded structure meshing with and engaging the outer threads of the linear member.

7. The device as claimed in claim 1 wherein said tubular body comprises two half-shells.

8. The device as claimed in claim 7 wherein each of said half-shells contains at least one of said distribution channels.

* * * * *